US007416413B2

(12) United States Patent
Liao

(10) Patent No.: US 7,416,413 B2
(45) Date of Patent: Aug. 26, 2008

(54) PIVOTING ADAPTER STRUCTURE FOR ASSEMBLING PLUGS

(76) Inventor: Sheng-Hsin Liao, No. 10, Alley 38, Lane 229, San Chun St., Shulin City (TW)

( * ) Notice: Subject to any disclaimer, the term of this patent is extended or adjusted under 35 U.S.C. 154(b) by 0 days.

(21) Appl. No.: 11/635,592

(22) Filed: Dec. 8, 2006

(65) Prior Publication Data

US 2007/0197053 A1 Aug. 23, 2007

Related U.S. Application Data

(63) Continuation-in-part of application No. 11/432,531, filed on May 12, 2006, now Pat. No. 7,255,567.

(30) Foreign Application Priority Data

Feb. 21, 2006 (TW) ..... 95105793 A

(51) Int. Cl.
*H01R 39/00* (2006.01)

(52) U.S. Cl. ..... 439/11; 439/676; 439/638

(58) Field of Classification Search ..... 439/11, 439/676, 638, 640, 217, 218
See application file for complete search history.

(56) References Cited

U.S. PATENT DOCUMENTS 5,964,610 A * 10/1999 McCoy ..... 439/218
6,213,782 B1 * 4/2001 Derstine ..... 439/31
6,276,943 B1 * 8/2001 Boutros et al. ..... 439/76.1
6,520,794 B2 * 2/2003 Liao ..... 439/418
6,695,620 B1 * 2/2004 Huang ..... 439/11
6,913,392 B2 * 7/2005 Grzegorzewska et al. ..... 385/60
6,935,877 B2 * 8/2005 Liao ..... 439/170
7,108,562 B2 * 9/2006 Liao ..... 439/676
7,189,089 B1 * 3/2007 Liao ..... 439/170
2006/0258224 A1 * 11/2006 Liao ..... 439/638
2007/0111608 A1 * 5/2007 Huang ..... 439/676
2007/0197052 A1 * 8/2007 Liao ..... 439/11
2008/0050975 A1 * 2/2008 Liao ..... 439/660

* cited by examiner

*Primary Examiner*—Renee S Luebke
*Assistant Examiner*—Vanessa Girardi
(74) *Attorney, Agent, or Firm*—Rosenberg, Klein & Lee

(57) ABSTRACT

A composite simple plug includes an insulating case, a plurality of terminals, a plug for an Internet line or a telephone line, and a fastener. The insulating case has a trough. The terminals are located in the insulating case and are exposed to the trough. The connector is located at the front end of the insulating case and electrically connected with the terminals. The fastener is located near the front end of the insulating case. The insulating case is suitable for a variety of plugs. The composite simple plug can be connected with a plug for an Internet line, or is connected with a linking element. The converting method is simple. The fastener firmly fastens the plug for an Internet line or the linking element so that the plug for an Internet line will not come away from the composite simple plug.

37 Claims, 7 Drawing Sheets

PIVOTING ADAPTER STRUCTURE FOR ASSEMBLING PLUGS

CROSS-REFERENCE TO RELATED APPLICATIONS

This application is a Continuous-in-part of application Ser. No. 11/432,531, filed on 12 May 2006, now U.S. Pat. No. 7,255,567 and entitled "COMPOSITE SIMPLE PLUG".

BACKGROUND OF THE INVENTION

1. Field of the Invention

The present invention relates to a composite simple plug. In particular, this invention relates to a structure that is connected with a connector and a plug for an Internet line or a plug for a telephone. The connector can be replaced by a variety of connectors with different formats and the plug for an Internet line and the plug for a telephone are exchangeable.

2. Description of the Related Art

The converting plug can be converted into two different plugs according to requirements. For example, the plug for a telephone line can be converted into a plug for an Internet line.

The application patent U.S. Ser. No. 11/432531 is a related patent applied for by this invention. The composite simple plug includes an insulating case, a plurality of terminals, a connector, and a linking element. The terminals are installed in the insulating case, and electrically connected with the connector. The insulating case is directly pivoted with a plug for the Internet line. Furthermore, the insulating case can be pivoted with a linking element so that a plug for the telephone line can be plugged into the insulating case. However, this related case must utilize the linking element to convert a plug for an Internet line into a plug for a telephone line. It is inconvenient.

SUMMARY OF THE INVENTION

One particular aspect of the present invention is to provide a composite simple plug. The insulating case of the plug can connect with plugs that have different formats.

Another particular aspect of the present invention is the use of an insulating case having an adapter function to connect with a plug for an Internet line or a plug for a telephone line. Therefore, the composite simple plug can be converted into different types of plugs. The insulating case utilizes a linking element to convert the plug for an Internet line into a plug for a telephone line, or convert the plug for a telephone line into a plug for an Internet line. The linking element is connected between the insulating case and the plug for a telephone line to form a composite simple plug structure. Its structure is simple, its dimensions are small, the cost of the plug is reduced, and it is convenient for carrying around. The composite simple plug can be easily converted into different plugs.

A further particular aspect of the present invention is to install a fastener near the front end of the insulating case. Thereby, the plug for an Internet line or the linking element can be firmly fastened so that the plug for an Internet line or the plug for a telephone line will not come away from the composite simple plug.

The composite simple plug includes an insulating case having a trough, a plurality of terminals located in the insulating case, a connector located at the front end of the insulating case, and a fastener located near the front end of the insulating case. One end of the terminals is exposed to the trough. The connector is electrically connected with the terminals.

Via the described structure, the trough of the insulating case can movably pivot with a plug for an Internet line, and the plug for an Internet line is electrically connected with the terminals. Alternatively, the trough can movably pivot with a linking element. The linking element is connected with a plug for a telephone line, and the plug for a telephone line is electrically connected with the terminals. At the same time, the fastener firmly fastens the plug for an Internet line or the linking element so that the plug for an Internet line or the plug for a telephone line will not come away from the composite simple plug.

For further understanding of the invention, reference is made to the following detailed description illustrating the embodiments and examples of the invention. The description is only for illustrating the invention and is not intended to be considered limiting of the scope of the claim.

BRIEF DESCRIPTION OF THE DRAWINGS

The drawings included herein provide a further understanding of the invention. A brief introduction of the drawings is as follows.

DETAILED DESCRIPTION OF THE PREFERRED EMBODIMENTS

Figure 1:
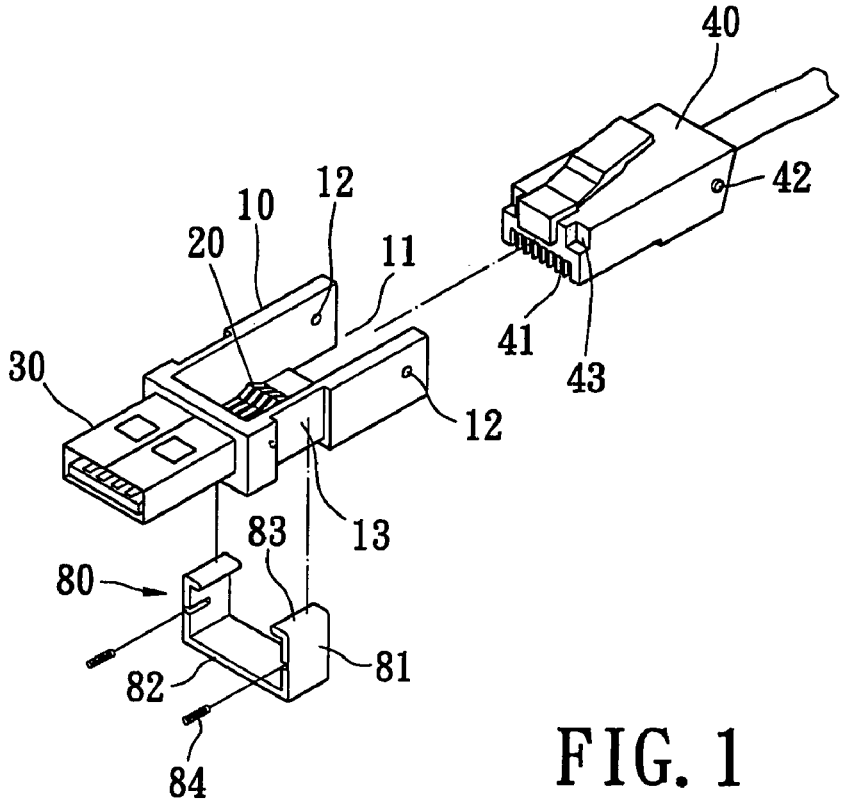
FIG. 1 is a first exploded perspective view of the present invention connected with a plug for an Internet line.
Figure 2:
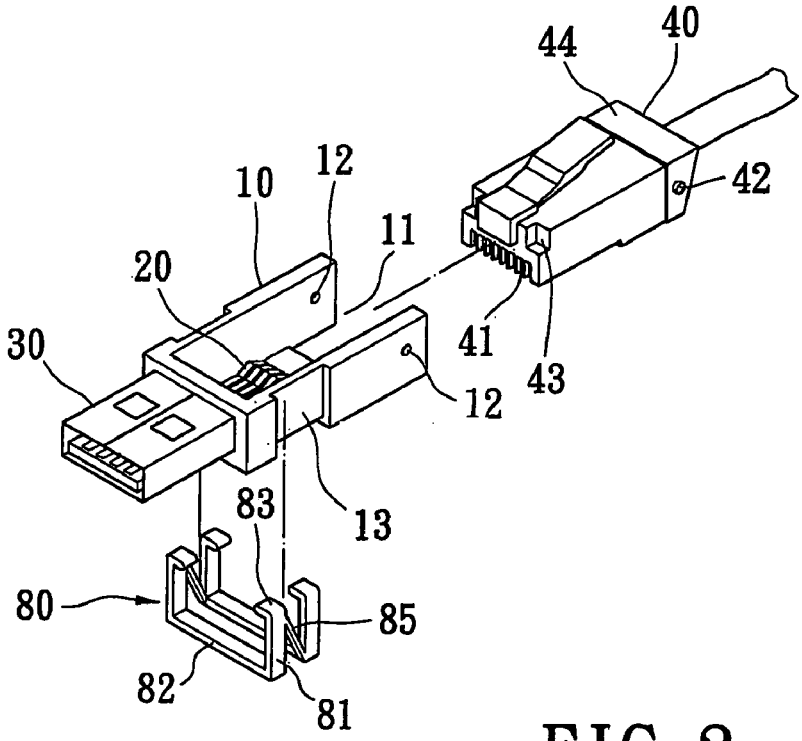
FIG. 2 is a second exploded perspective view of the present invention connected with a plug for an Internet line.

Reference is made to FIGS. 1 and 2. The composite simple plug includes an insulating case 10, a plurality of terminals 20, a connecter 30, and a fastener 80.

The insulating case 10 is made of insulating materials, such as a plastic material. A trough 11 is formed at the top of the insulating case 10, and the rear end of the trough 11 is hollow. At two side walls of the trough 11 of the insulating case 10, there are two first pivoting parts 12 that are opposite to each other and are located at near the rear end of the trough 11. The two first pivoting parts 12 are circular holes, columns, or open slots.

The terminals 20 are made of conductive metal material. The number of the terminals is not limited to a specified number. The terminals 20 are disposed in the insulating case 10 at an equal distance from each other. One end of the terminals 20 is bent and exposed to the trough 11. The connector 30 is located at the front end of the insulating case 10, and is electrically connected with the second end of the terminals 20. The connector 30 can be a USB connector, a voice-signal connector, or a DC connector. Thereby, the insulating case 10 functions as an adapter via the terminals 20 and the connector 30.

The fastener 80 is located near the front end of the insulating case 10 and adjacent to the connector 30, as shown in FIG. 1. FIG. 1 is the first embodiment of the fastener 80. At the outer surface near the front end of the insulating case 10, there is a combining trough 13 that is U-shaped and concaves inward for fastening the fastener 80. The combining trough 13 is U-shaped and flexible. The fastener 80 has two side parts 81 that respectively clip the two side surfaces of the combining trough 13, a bottom 82 that is connected with the two side parts and leans against the bottom of the combining trough 13, and two fastening parts 83 that extend inwards from the free end of the two side parts 82. Between the side parts 81 and the insulating case 10, there are two flexible elements 84, such as springs or similar flexible elements. One end of the flexible element 84 is received in the wall of the combining trough 13, and another end of the flexible element 84 is received in the side part 81. Therefore, the fastener 80 can elastically move forwards and backwards. Alternatively, it can also achieve the same function through installing a flexible element 84.

FIG. 2 shows the second embodiment of the fastener 80. The difference between the second embodiment and the first embodiment is that there is a plurality of fasteners 80. In this embodiment, two fasteners 80 are taken as an example. The two fasteners 80 are fastened to the combining trough 13. The adjacent sides of the side parts 81 are connected to a flexible part 85, such as a rubber or spring, so that the fastener 80 can elastically move forwards and backwards.

Figure 3:
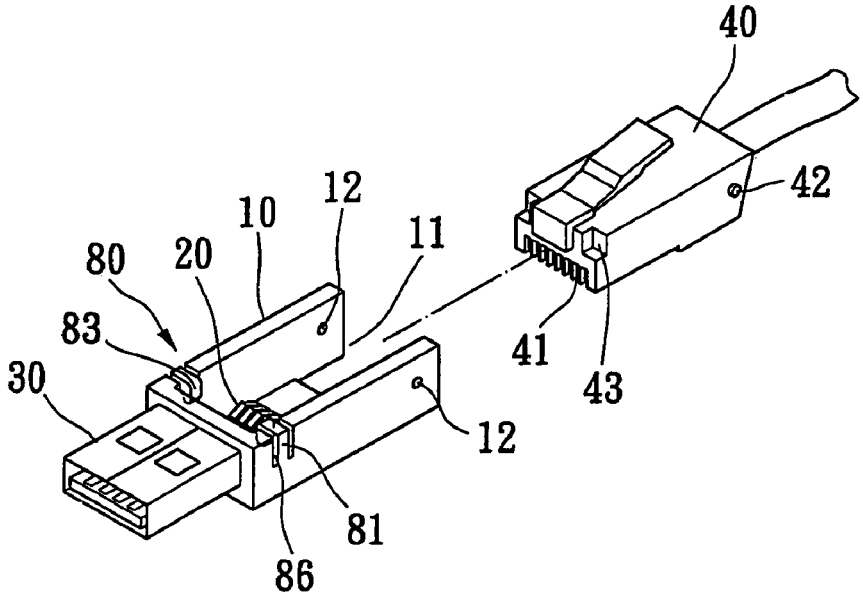
FIG. 3 is a third exploded perspective view of the present invention connected with a plug for an Internet line.

FIG. 3 shows the third embodiment of the fastener 80. The difference between the third embodiment and the first embodiment is that the fastener 80 has two flexible side parts 81 that are formed by respectively forming two opening slots 86 at two sides near the front end of the insulating case 10. A fastening part 83 extends inwards from the free end of the side part 81.

Furthermore, the insulating case 10 includes terminals 20 and the connector 30. The trough 11 is movably pivoted with a plug for an Internet line 40 having 8 pins. The pins of the plug of an Internet line 40 are electrically connected with the terminals 20 of the insulating case 10. Two second pivoting parts 42 are respectively located at the two sides near the rear end of the plug for an Internet line 40. The second pivoting parts 42 are circular holes, columns, or open slots. The second pivoting parts 42 of the plug for an Internet line 40 are respectively and movably pivoted to the first pivoting parts 12 of the insulating case 10. Therefore, the plug for an Internet line 40 is pivoted with the trough 11 of the insulating case 10 by either rotating or moving forwards and backwards (for example, the column is fastened into the open slot).

Reference is made to FIGS. 1 and 2. In the first embodiment and the second embodiment of the fastener 80, when the plug for an Internet line 40 is pivoted with the insulating case 10, the fastener 80 fastens to the combining trough 13 of the insulating case 10 so that the fastening parts 83 firmly clip onto two sides near the front end of the plug for an Internet line 40.

Figure 4:
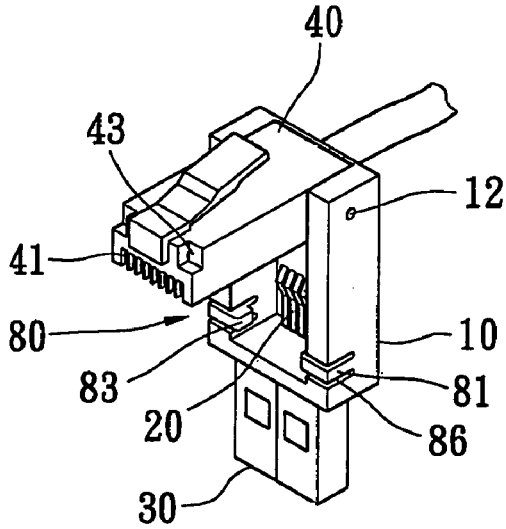
FIG. 4 is a movable assembly schematic diagram of the present invention connected with a plug for an Internet line.

Reference is made to FIGS. 3 and 4. In the third embodiment of the fastener 80, two openings 43 are respectively located at two sides of the front end of the plug for an Internet line 40. The fastening parts 83 of the fastener 80 are wedged to the openings 43 of the plug for an Internet line 40 so that the plug for an Internet line 40 is firmly fastened to the trough 11 of the insulating case 10. The plug for an Internet line 40 will not sway and come away from the insulating case 10.

Therefore, the present invention can be connected with the plug for an Internet line 40 and the connector 30 via the insulating case 10 so that the insulating case 10 is directly converted into two formats. The plug for an Internet line 40 can be plugged into electronic devices, such as a laptop or a desktop PC, by connecting with a connector 30. The plugging socket for an Internet line on the electronic devices can be simplified. The thickness of the electronic devices is reduced. Furthermore, when the plug is carried around, it does not occupy a large amount of space. Moreover, the fastener 80 can firmly fasten the plug for an Internet line 40 and the plug for an Internet line 40 will not be taken off.

As shown in FIG. 2, the structure of the plug for an Internet line 40 can be changed, a glue-covering layer 44 is formed at the rear end of the plug for an Internet line 40 by a molding method. The second pivoting parts 42 are formed at two sides of the glue-covering layer 44.

Reference is made to FIGS. 5~10. Because the dimensions of the plug for an Internet line 40 and the plug for a telephone line 60 are different, the trough 11 of the insulating case 10 is further movably pivoted with a linking element 50. The linking element 50 has a supporting frame 51, and two side arms 52 extend outwards from the left and right sides of the supporting frame 51. At the inner side of the two side arms 52 near to rear ends, there are third pivoting parts 53 that are opposite to each other. The third pivoting parts 12 are circular holes, columns, or open slots. On an outside of the two side arms 52 near to rear ends, there are fourth pivoting parts 54 that are opposite to each other. The fourth pivoting parts 54 are circular holes, columns, or open slots. The two third pivoting parts correspond to the two fourth pivoting parts 54. On a bottom of the front end of the plug for a telephone line 60, there are pins 61. At two sides near to a rear end of the plug for a telephone line 60, there are fifth pivoting parts 62 that are opposite to each other. The fifth pivoting parts 62 are circular holes, columns, or open slots. There are two concave openings 55 respectively located at a front end of the two side arms 52. On top of the front end of the two side arms 52, fixing parts 56 respectively extend inwards. The two fixing parts 56 are both arc-shaped.

By movably pivoting the third pivoting parts 53 of the linking element 50 with the fifth pivoting parts 62 of the plug for a telephone line 60 and movably pivoting the fourth pivoting parts 54 of the linking element 50 with the first pivoting parts 12 of the trough 11, the linking element 50 and the plug for a telephone line 60 are movably pivoted in the trough 11 of the insulating case 10. Therefore, the pins 61 of the plug for a telephone line 60 are electrically connected with the terminals 20 of the insulating case 10. Thereby, the present invention can be applied to plugs having different formats (such as the plug for an Internet line 40 and the plug for a telephone line 60). When the plug for a telephone line 60 is pivoted with the linking element 50, the fixing parts 56 fasten the upper end of the plug for a telephone line 60 to prevent the plug for a telephone line 60 from swaying.

Figure 5:
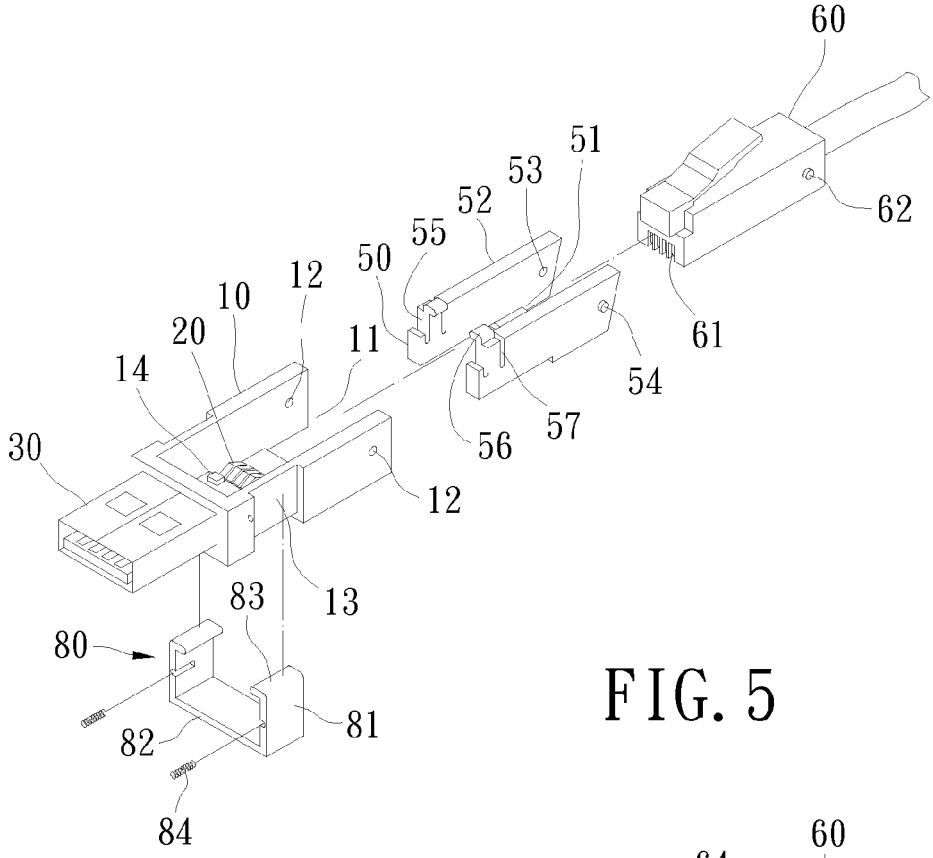
FIG. 5 is a first exploded perspective view of the present invention connected with a plug for a telephone line and a linking element.
Figure 6:
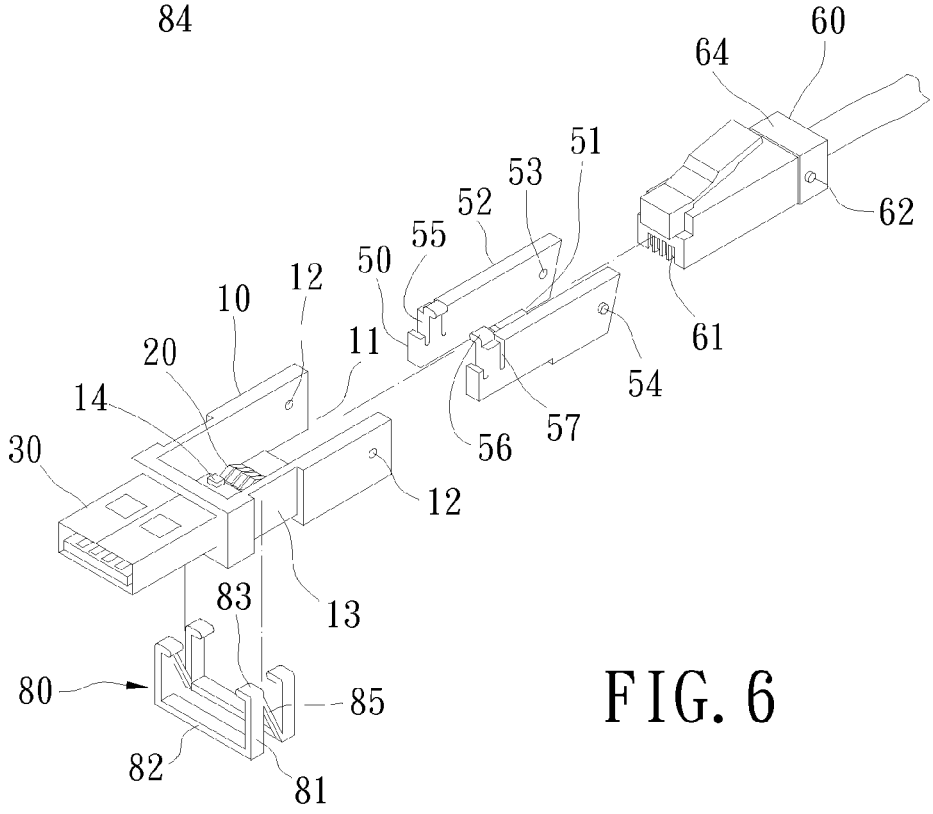
FIG. 6 is a second exploded perspective view of the present invention connected with a plug for a telephone line and a linking element.
Figure 7:
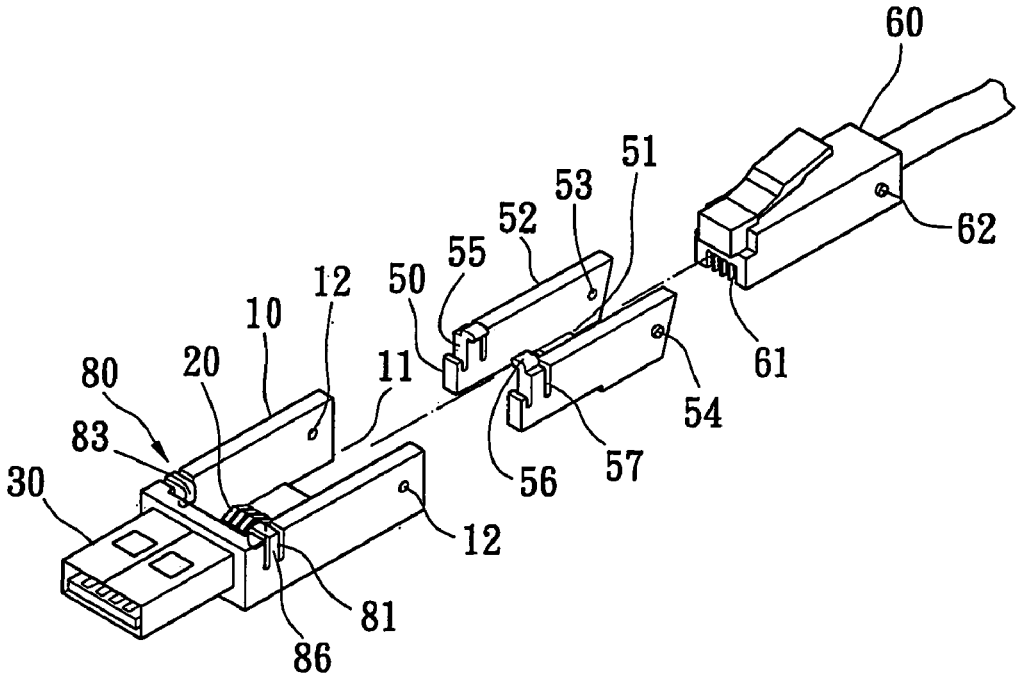
FIG. 7 is a third exploded perspective view of the present invention connected with a plug for a telephone line and a linking element.
Figure 8:
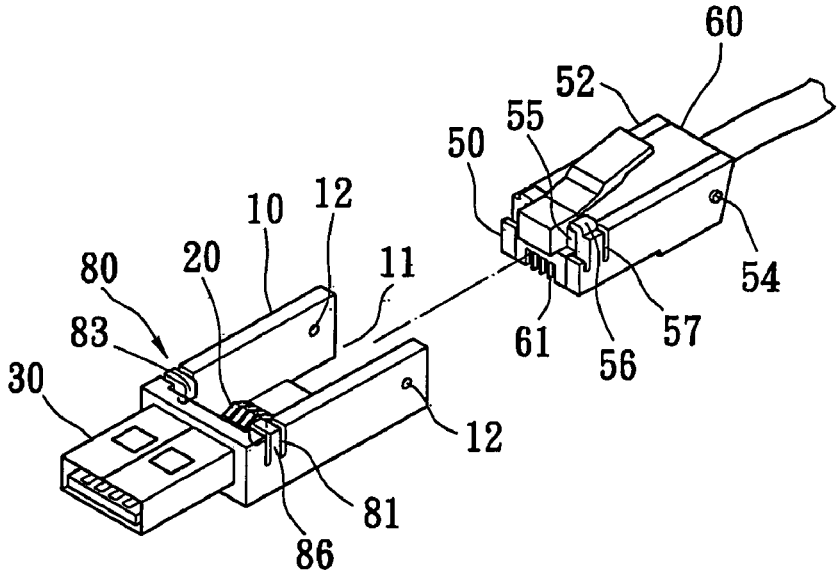
FIG. 8 is an assembly perspective view of the present invention connected with a plug for a telephone line and a linking element.
Figure 9:
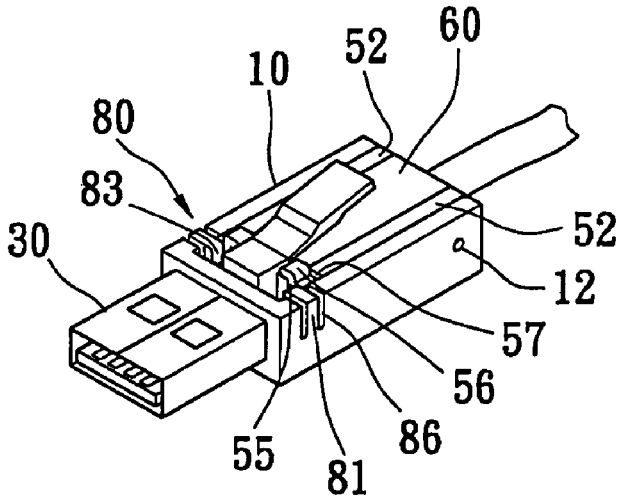
FIG. 9 is an assembly schematic diagram of the present invention connected with a plug for a telephone line and a linking element.
Figure 10:
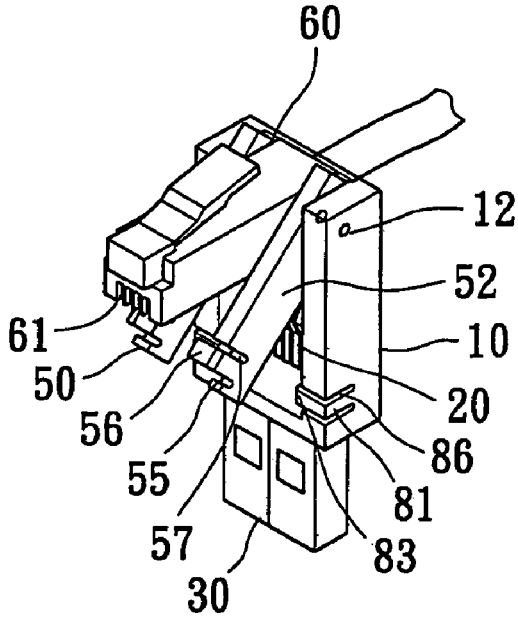
FIG. 10 is a movable assembly schematic diagram of the present invention connected with a plug for a telephone line and a linking element.

At the same time, by clipping the fastening parts 83 of the fastener 80 to the two sides of the fixing parts 56 of the linking element 50 (as shown in FIGS. 5 and 6), or fastening the fastening parts 83 onto the concave openings 55 of the linking element 50 (as shown in FIGS. 7~10), the linking element 50 is firmly clipped or fastened to prevent the plug for a telephone line 60 from coming away from the insulating case 10.

Alternatively, the linking element 50 merely has two side arms 52. The two side arms 52 are pivoted with the plug for a telephone line 60 and the insulating case 10 simultaneously to achieve the same function. Furthermore, at two sides of the fixing parts 56 of the two side arms of the linking element 50, grooves 57 are respectively formed so that the fixing parts 56 elastically fasten to the front end of the plug for a telephone line 60.

Figure 11:
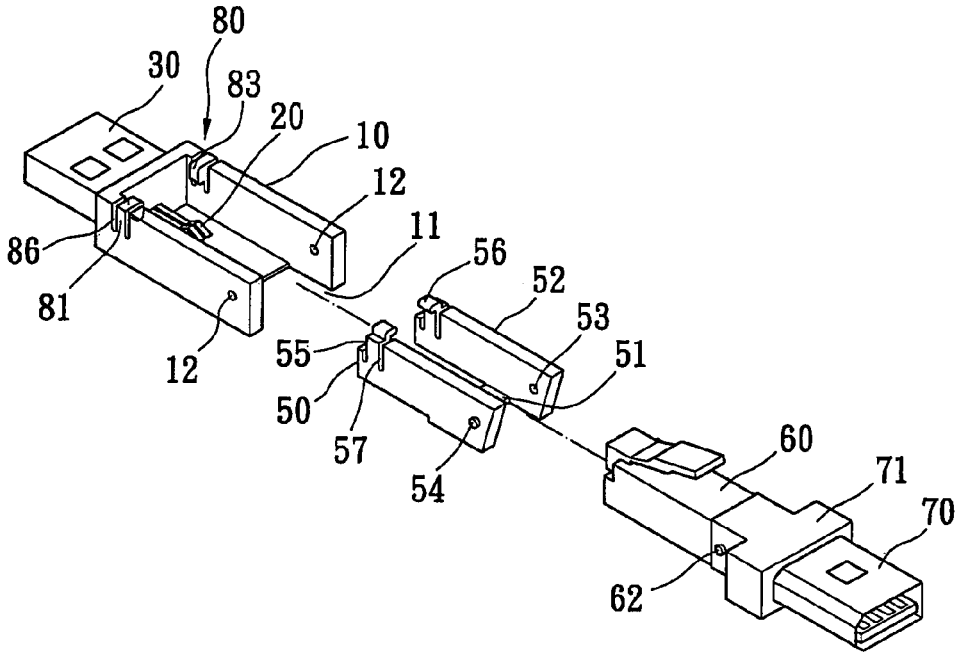
FIG. 11 is a schematic diagram of the plug for a telephone line of the present invention connected with a second connector.
Figure 12:
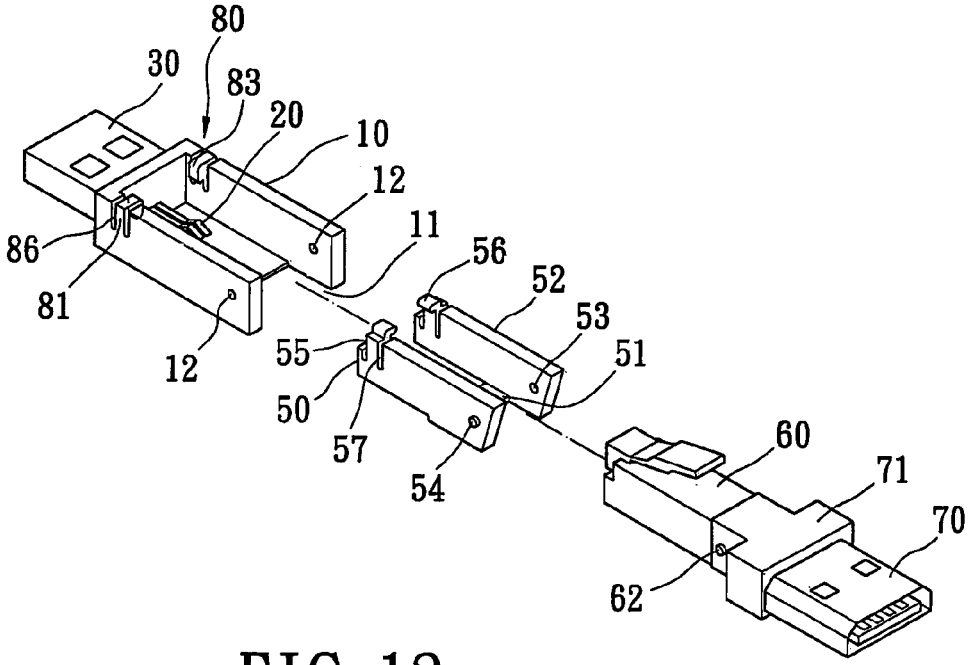
FIG. 12 is another schematic diagram of the plug for a telephone line of the present invention connected with a second connector.

The insulating case 10 further includes a circuit control element 14 (as shown in FIGS. 5 and 6), and the circuit control element 14 is located in the trough 11. The circuit control element 14 can be a circuit board, or is composed of a circuit board and a plurality of electronic elements. The terminals 20 are connected with the circuit control element 14, and the connector 30 is electrically connected with the circuit control element 14. Therefore, the connector 30 is electrically connected with the terminals 20. Reference is made to FIG. 11. The rear end of the plug for a telephone line 60 is connected with a second connector 70. The pins (not shown in the figure) of the plug for a telephone line 60 are electrically connected with the pins (not shown in the figure) of the second connector 70. Moreover, between the second connector 70 and the plug for a telephone line 60, a glue-covering layer 71 is formed by a molding method so that the plug for a telephone line 60 is combined with the second connector 70 and their pins are connected to and conducted to each other. Thereby, the second connector 70 also functions as an adapter. Furthermore, the fifth pivoting parts can be also located at two sides of the glue-covering layer 71 to achieve the same effect. The second connector 70 can be an IEEE1394, or a high-definition multimedia interface (HDMI) as shown in FIG. 12.

Figure 13:
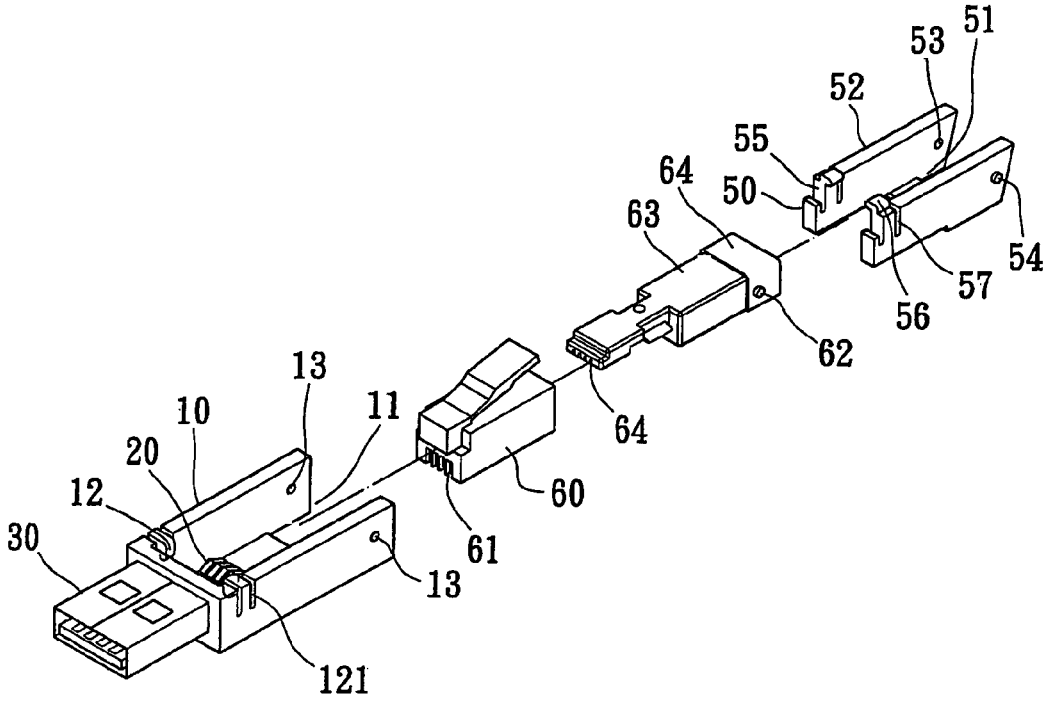
FIG. 13 is a schematic diagram of the plug for a telephone line of the present invention connected with a connector.

Reference is made to FIG. 13. The shape and the structure of the plug for a telephone line 60 can be changed, in this embodiment, the plug for a telephone line 60 is further connected with a connector 63 which is made of insulating materials, such as a plastic. The conducting lines (not shown in the figure) of the plug for a telephone line 60 pass through the connector 63. There is a plurality of line slots 64 at the front part of the connector 63. The conducting lines are plugged into the rear end of the connector 63 and placed in the line slots 64 so that the conducting lines are connected with the connector 63 in advance. Next, the connector 63 is plugged into the rear end of the plug for a telephone line 60 and the connector 63 is used for guiding the conducting lines to extend the front side of the interior of the plug for a telephone line 60. The connector 63 is fastened into the interior of the plug for a telephone line 60 so as to combine the connector 63 with the plug for a telephone line 60. Therefore, the pins 61 of the plug for a telephone line 60 are electrically connected with the conducting lines.

A glue-covering layer 65 also can be formed at the rear end of the connector 63. The fifth pivoting parts 62 are located at two sides of the glue-covering layer 65. The third pivoting parts 53 of the linking element 50 are movably pivoted with the fifth pivoting parts 62 of the connector 63.

Figure 14:
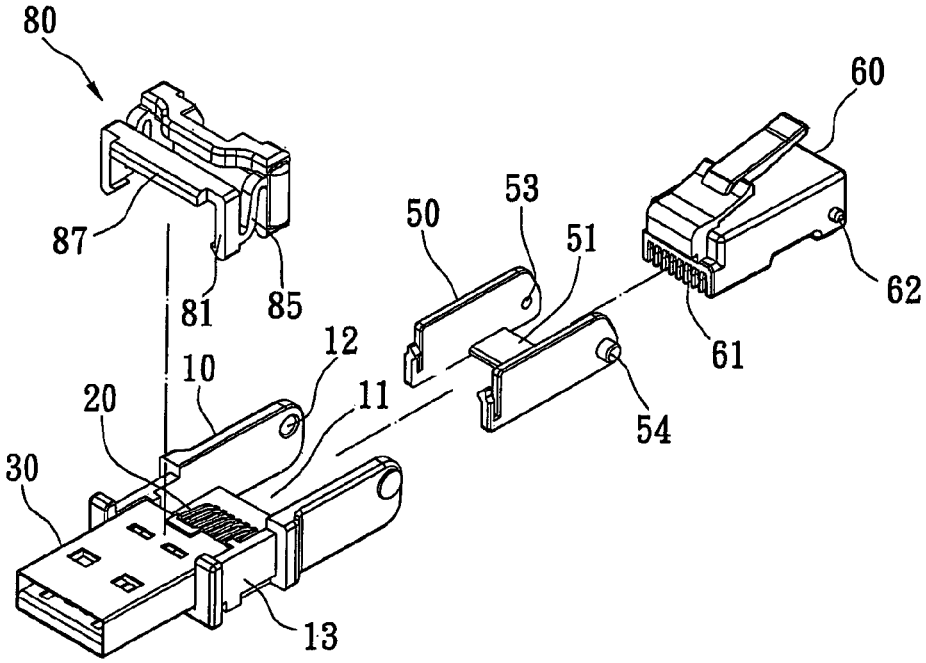
FIG. 14 is another assembly perspective view of the present invention connected with a plug for a telephone line and a linking element.

FIG. 14 shows the fourth embodiment of the fastener 80. The difference between the fourth embodiment and the first embodiment and the second embodiment is that the fastener 80 has two pairs of side parts 81, and a pair of tops 87 connected with the two pairs of side parts 81. The side parts 81 respectively lean against the two side surfaces of the combining trough 13. Between the adjacent side parts, there is flexible element 85. The top 87 near the front end is located between the connector 30 and the terminals 20 for covering and protecting the pins (not shown in the figure) in the connector 30 and the terminals 20. Another top 87 is located at the front end of the plug for a telephone line 60 (or the front end of the plug for an Internet line 40). By utilizing the flexible element 85, the top 87 elastically moves forwards and backwards and fastens the plug for a telephone line 60 and the linking element 50 (or the plug for an Internet line). The plug for a telephone line 60 can also be modified to change its function, such as increasing the number of the pins 61.

The insulating case 10 of the present invention can be connected with the plug for an Internet line to convert into two different plugs. By a smart structure, a variety of connectors 30 can be replaced for use as an adapter. By using the linking element 50, the plug for an Internet line can be replaced by the plugs for a telephone line 60 having different dimensions. By using the linking element 50, the insulating case 10 can be applied to the plug for an Internet line and the plug for a telephone line simultaneously. Its structure is simple, its dimensions are small, the cost of the plug is reduced, and it is convenient for carrying around. The composite simple plug can be easily converted into different plugs.

Furthermore, by using the fastener 80 to firmly fasten the plug for an Internet line 60 or the front end of the linking element 50, the plug for an Internet line 40 or the plug for a telephone line 60 will not come away from the insulating case 10. It is more convenient.

The description above only illustrates specific embodiments and examples of the invention. The invention should therefore cover various modifications and variations made to the herein-described structure and operations of the invention, provided they fall within the scope of the invention as defined in the following appended claims.

What is claimed is:

1. A composite simple plug, comprising:

an insulating case having a trough, a plurality of terminals located in the insulating case, wherein one end of the terminals is exposed to the trough;

a first connector located at a front end of the insulating case, wherein the first connector is electrically connected with the terminals;

a second connector received within said trough of said insulating casing and pivotally mounted thereto; and, a fastener located near the front end of the insulating case for fastening said first connector to said second connector.

2. The composite simple plug as claimed in claim 1, wherein there is a combining trough for fastening the fastener at the outer surface near the front end of the insulating case, the fastener has two pairs of side parts, and a pair of tops connected with the two pairs of side parts, the side parts respectively lean against two side surfaces of the combining trough, there is flexible element between the side parts, one top is located between the connector and the terminals, and another top elastically moves.

3. The composite simple plug as claimed in claim 1, wherein the fastener has flexible side parts that are formed by respectively forming two opening slots at two sides near the front end of the insulating case, and a fastening part that extends inwards from the free end of the side part.

4. The composite simple plug as claimed in claim 1, wherein there is a combining trough for fastening the fastener at the outer surface near the front end of the insulating case, the fastener has two side parts that respectively clip two side surfaces of the combining trough, a bottom that is connected with the two side parts and leans against a bottom of the combining trough, and two fastening parts that extend inwards from a free end of the two side parts.

5. The composite simple plug as claimed in claim 4 wherein there is a flexible element between the two side parts and the insulating case so that the fastener moves elastically.

6. The composite simple plug as claimed in claim 4, wherein the fastener is composed of a plurality of separated spaces fastening to the combining trough, there is a flexible element between the side parts so that the fastener moves elastically.

7. The composite simple plug as claimed in claim 1, wherein a circuit control element is located between the connector and the terminals so that the connector is electrically connected with the terminals.

8. The composite simple plug as claimed in claim 7, wherein the circuit control element is a circuit board.

9. The composite simple plug as claimed in claim 7, wherein the circuit control element is composed of a circuit board and a plurality of electronic elements.

10. The composite simple plug as claimed in claim 1, further comprising a linking element movably pivoted with the trough.

11. The composite simple plug as claimed in claim 10 wherein the linking element has a supporting frame, and two side arms that extend outwards from two sides of the supporting frame.

12. The composite simple plug as claimed in claim 11, wherein there are two pivoting parts located near the rear end of the insulating case and another two pivoting parts located near an outer side of the rear end of the two side arms so that the linking element is movably pivoted with the trough of the insulating case.

13. A composite simple plug, comprising:

an insulating case having a trough, a plurality of terminals located in the insulating case, wherein one end of the terminals is exposed to the trough;

a connector located at a front end of the insulating case, wherein the connector is electrically connected with the terminals;

a plug received in said trough for an Internet line pivotably mounted to the insulating case, wherein the plug for the Internet line is electrically connected with the terminals; and a fastener located near the front end of the insulating case, said fastener engaging at least one side wall of said insulating case and said plug for engagement therewith to restrain said plug from pivoting with respect to said insulating case, for fastening the plug to said Internet line.

14. The composite simple plug as claimed in claim 13 wherein there is a combining trough for fastening the fastener at the outer surface near the front end of the insulating case, the fastener has two pairs of side parts, and a pair of tops are connected with the two pairs of side parts, the side parts respectively lean against two side surfaces of the combining trough, there is flexible element between the side parts, one top is located between the connector and the terminals, and another top elastically moves and fastens to the front end of the plug for an Internet line.

15. The composite simple plug as claimed in claim 13, wherein the fastener has flexible side parts that are formed by respectively forming two opening slots at two sides near the front end of the insulating case, and a fastening part extends inwards from the free end of the side part for fastening the front end of the plug for the Internet line.

16. The composite simple plug as claimed in claim 13, wherein there is a combining trough for fastening the fastener at an outer surface near the front end of the insulating case, the fastener has two side parts that respectively clip two side surfaces of the combining trough, a bottom that is connected with the two side parts and leans against a bottom of the combing trough, and two fastening parts that extend inwards from a free end of the two side parts for fastening the front end of the plug for the Internet line.

17. The composite simple plug as claimed in claim 16, wherein there is a flexible element between the two side parts and the insulating case so that the fastener moves elastically.

18. The composite simple plug as claimed in claim 16, wherein the fastener is composed of a plurality of separated spaces fastening to the combining trough, there is a flexible element between the side parts so that the fastener moves elastically.

19. The composite simple plug as claimed in claim 13, wherein there are two first pivoting parts located near a rear end of the insulating case and two second pivoting parts located near a rear end of the plug for the Internet line, the second pivoting parts of the plug for an Internet line are movably pivoted with the first pivoting parts of the insulating case so that the plug for the Internet line is movably pivoted with the trough of the insulating case.

20. The composite simple plug as claimed in claim 19, wherein there is a glue-covering layer located at the rear end of the plug for the Internet line, and the second pivoting parts are formed at two sides of the glue-covering layer.

21. The composite simple plug as claimed in claim 13 wherein a circuit control element is located between the connector and the terminals so that the connector is electrically connected with the terminals.

22. The composite simple plug as claimed in claim 21, wherein the circuit control element is a circuit board.

23. The composite simple plug as claimed in claim 21, wherein the circuit control element is composed of a circuit board and a plurality of electronic elements.

24. A composite simple plug, comprising:

an insulating case having a trough, a plurality of terminals located in the insulating case, wherein one end of the terminals is exposed to the trough;

a connector located at a front end of the insulating case, wherein the connector is electrically connected with the terminals;

a linking element received within the trough and pivotally mounted to said insulating casing;

a plug for a telephone line received by the linking element and pivotally mounted thereto, said linking element and said plug being received within the trough of the insulating case, wherein the plug for a telephone line is electrically connected with the terminals; and a fastener located near the front end of the insulating case for engaging said linking element to restrain said linking element from pivoting with respect to said insulating casing for fastening the linking element.

25. The composite simple plug as claimed in claim 24, wherein there is a combining trough for fastening the fastener at the outer surface near the front end of the insulating case, the fastener has two pairs of side parts, and a pair of tops connected with the two pairs of side parts, the side parts respectively lean against two side surfaces of the combining trough, there is flexible element between the side parts, one top is located between the connector and the terminals, and another top elastically moves and fastens the linking element and the front end of the plug for a telephone line.

26. The composite simple plug as claimed in claim 24 wherein the fastener has flexible side parts that are formed by respectively forming two opening slots on two sides near the front end of the insulating case, and a fastening part extends inwards from the free end of the side part for fastening the front end of the linking element.

27. The composite simple plug as claimed in claim 24, wherein there is a combining trough for fastening the fastener at an outer surface near the front end of the insulating case, the fastener has two side parts that respectively clip two side surfaces of the combing trough, a bottom that is connected with the two side parts and leans against a bottom of the combining trough, and two fastening parts that extend inwards from a free end of the two side parts for fastening the front end of the linking element.

28. The composite simple plug as claimed in claim 27, wherein there is a flexible element between the two side parts and the insulating case so that the fastener moves elastically.

29. The composite simple plug as claimed in claim 27, wherein the fastener is composed of a plurality of separated spaces fastened to the combining trough, there is a flexible element between the side parts so that the fastener moves elastically.

30. The composite simple plug as claimed in claim 24, wherein there are two first pivoting parts located near a rear end of the insulating case, two third pivoting parts located near an inner side of the rear end of the two side arms of the linking element, two fourth pivoting parts located near an outer side of a rear end of the two side arms of the linking element, and two fifth pivoting parts located near a rear end of the plug for a telephone line, wherein the third pivoting parts of the linking element are movably pivoted with the fifth pivoting parts of the plug for a telephone line, and the fourth pivoting parts of the linking element are movably pivoted with the first pivoting parts of the insulating case so that the linking element and the plug for a telephone line are movably pivoted with the trough of the insulating case.

31. The composite simple plug as claimed in claim 30, wherein there is a glue-covering layer located on the rear end of the plug for a telephone line, and the fifth pivoting parts are formed at two sides of the glue-covering layer.

32. The composite simple plug as claimed in claim 30, wherein there are two fixing parts respectively located near the front end of the two side arms, grooves are respectively located on two sides of the fixing parts so that the fixing parts elastically fasten the front end of the plug for a telephone line.

33. The composite simple plug as claimed in claim 24, wherein a circuit control element is located between the connector and the terminals so that the connector is electrically connected with the terminals.

34. The composite simple plug as claimed in claim 33, wherein the circuit control element is a circuit board.

35. The composite simple plug as claimed in claim 33, wherein the circuit control element is composed of a circuit board and a plurality of electronic elements.

36. The composite simple plug as claimed in claim 24, wherein a rear end of the plug for a telephone line is connected with a second connector, and the plug for a telephone line is electrically connected with the second connector.

37. The composite simple plug as claimed in claim 36, wherein the second connector an IEEE 1394 or an HDMI.

* * * * *